United States Patent [19]

Majewski

[11] Patent Number: 4,636,640

[45] Date of Patent: Jan. 13, 1987

[54] CORONA DISCHARGE ELECTRODE ASSEMBLY

[75] Inventor: Joseph R. Majewski, South Milwaukee, Wis.

[73] Assignee: Pillar Corporation, Milwaukee, Wis.

[21] Appl. No.: 510,120

[22] Filed: Jul. 1, 1983

[51] Int. Cl.[4] ..... G03G 15/00

[52] U.S. Cl. ..... 250/324; 250/325

[58] Field of Search ..... 250/324, 325, 326, 423 R; 361/225, 230, 231; 355/3 CH

[56] References Cited

U.S. PATENT DOCUMENTS

| | | | |
|---|---|---|---|
| 2,863,063 | 12/1958 | Schulze | 361/225 |
| 3,684,364 | 8/1972 | Schmidlin | 250/325 |
| 3,743,830 | 7/1973 | Takahashi et al. | 250/325 |
| 3,778,690 | 12/1973 | Rothacker et al. | 250/325 |
| 3,789,222 | 1/1974 | Sato | 250/325 |
| 3,887,809 | 6/1975 | Marx et al. | 250/325 |
| 4,556,795 | 12/1985 | Tietje | 250/324 |
| 4,564,759 | 1/1986 | Tietje | 250/324 |

*Primary Examiner*—Carolyn Fields
*Assistant Examiner*—Richard Hanig
*Attorney, Agent, or Firm*—Ronald E. Barry

[57] ABSTRACT

A corona discharge device includes a first electrode assembly comprising a roll formed of conductive material and a second electrode assembly including a conductive member having a ceramic element mounted on the conductive member in arranged generally parallel to the rotational axis of the conductive roll. According to a first embodiment, the second electrode assembly comprises a plurality of electrodes mounted for pivotal movement on one of a pair of support rods arranged in a parallel relation to each other and to the roll. First and second groups of electrodes are disposed on each of the respective rods in a staggered relation to each other.

10 Claims, 4 Drawing Figures

CORONA DISCHARGE ELECTRODE ASSEMBLY

BACKGROUND OF THE INVENTION

This invention relates to electrodes for corona discharge devices.

Corona discharge devices of the type contemplated herein include a plurality of electrodes each formed by a hollow ceramic body having a conductive member cemented within the body and connected by a conductive post to an electrical conductor. In addition, an insulating material such as Teflon is disposed in the hollow interior of the ceramic body and in surrounding relation to the conductive post. The electrodes are mounted in a side-by-side relation and aligned generally in a parallel relation to the other electrode. This type of prior art device, while an improvement over the prior art as it existed at that time, had several shortcomings. These included a tendency to overheat due to the presence of an adhesive in said hollow ceramic body, to arc over, i.e., high voltage breakdown between the two electrodes automatically switching the corona discharge apparatus off, and to jam if engaged by the material being treated. The side-by-side relation of the electrodes often resulted in thin strips of untreated material below the gap between the electrodes.

SUMMARY OF THE INVENTION

It is an object of the invention to provide a new and improved corona treating apparatus.

Another object of the invention is to provide an electrode for a corona discharge device in which heating is reduced.

A further object of the invention is to provide a corona treating device which is not subject to damage if engaged by the materials being treated. Still another object of the invention is to provide a corona discharge device which includes electrodes having hollow ceramic bodies mounted thereon wherein arcing around the ceramic insulating rim is minimized.

A still further object of the invention is to provide a corona discharge device wherein the hollow ceramic elements may be rapidly replaced.

In general terms, the invention comprises a corona discharge device including an elongated first electrode assembly including a conductive roll, and a second electrode assembly including a plurality of electrodes each including a conductive member having a hollow ceramic element defined by a base and a side wall mounted thereon. The electrodes are mounted in spaced relation with respect to the first electrode assembly with the elements mounted on the electrodes with the base adjacent the surface of the conductive roll. The conductive members each include a head portion and a pair of legs extending from the head portion, with the legs being configured to resiliently engage the inner surface of the side wall of the ceramic element to resiliently hold the ceramic element thereon and also providing a pivotal connection to the support means.

DESCRIPTION OF THE PREFERRED EMBODIMENT

Figure 1:
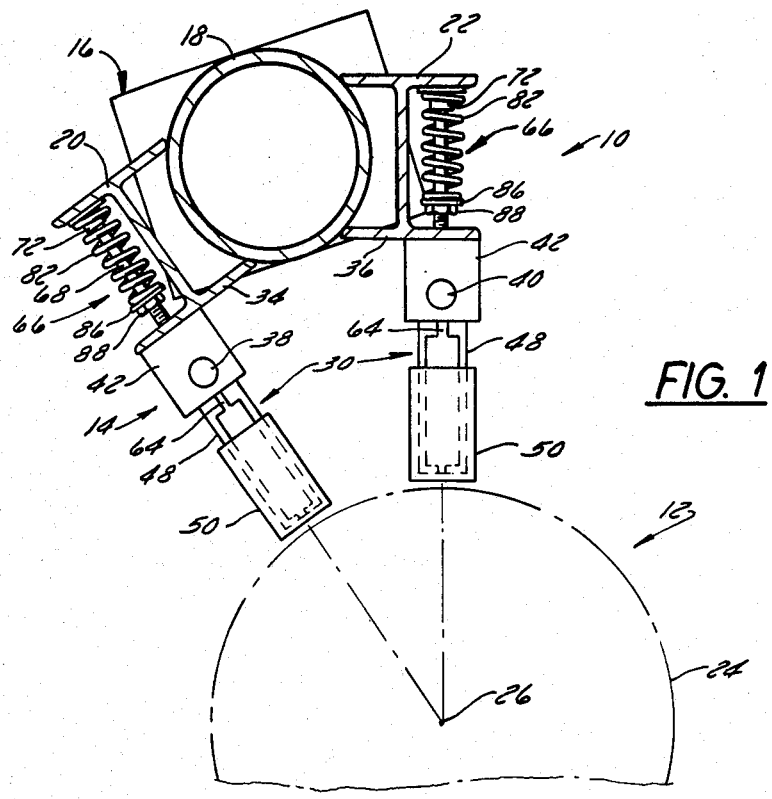
FIG. 1 is a side elevational view schematically illustrating a corona discharge device in accordance with one embodiment of the present invention.
Figure 2:
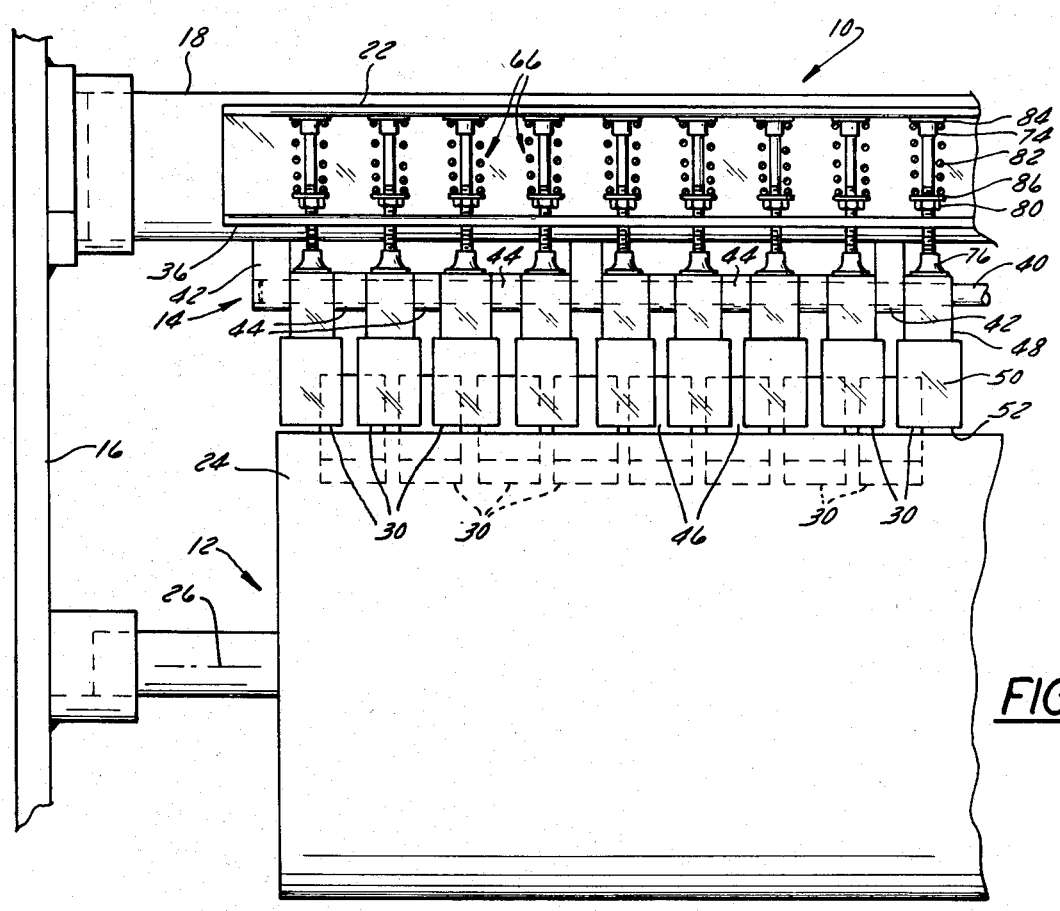
FIG. 2 is a front view of the discharge device illustrated in FIG. 1.

Referring to FIGS. 1 and 2, the corona discharge device 10 according to the invention is shown having a first electrode assembly 12 and a second electrode assembly 14 mounted on a frame 16. The frame 16 includes a hollow tubular member 18 having a pair of I-beam members 20 and 22 mounted thereon. The first electrode assembly 12 includes an electrically conductive roll 24 formed of stainless steel or the like mounted for rotation on said frame 16 about an axis 26 which is generally parallel to the I-beams 20 and 22.

The second electrode assembly is formed by means of a number of individual electrodes or segments 30. It will be appreciated that a suitable power supply means (not shown) is coupled to the first electrode assembly 12 and the second electrode assembly 14 to produce a corona discharge in the gap between the electrodes. It should be understood that various materials can be treated by passing the materials through the gap. The I-beam members 20 and 22 are mounted on the tubular member 18 with the lower surfaces of flanges 34 and 36 intersecting at an obtuse angle.

The power supply means is of the conventional type employed for corona discharge devices and its details form no part of the present invention. Accordingly, the power supply means will not be illustrated and described for the sake of brevity. As those skilled in the art will appreciate, however, the power supply means is of a type that provides a high voltage wave which alternates at a frequency in the order of 6–30 KHZ, for example. The power supply means is operatively connected to the roll 24 and to the electrodes 30 or to the single electrode 32 so that a corona discharge will appear between the electrodes 30 or 32 and the roll 24.

Referring to FIGS. 1 through 4, the electrodes 30 are shown pivotally mounted on the frame 16 by means of bars or rods 38 and 40. In this regard, it should be noted that the bars 38 and 40 are each supported on I-beams 20 and 22 by means of brackets 42 extending downwardly from the bottom of flanges 34 and 36. The bars 38 and 40 are oriented generally parallel to each other and to the rotational axis 26 of roll 24. The electrodes 30 extend normally from the bars 38 and 40 and radially relative to the axis 26 of roll 24. The electrodes 30 are separated by means of spacers 44 so that a gap 46 exists there between. The electrodes 30 on bar 38 are staggered relative to the electrodes 30 on bar 40 so that the former span the gap 46 between the latter and vice versa as shown in FIG. 2.

Figure 4:
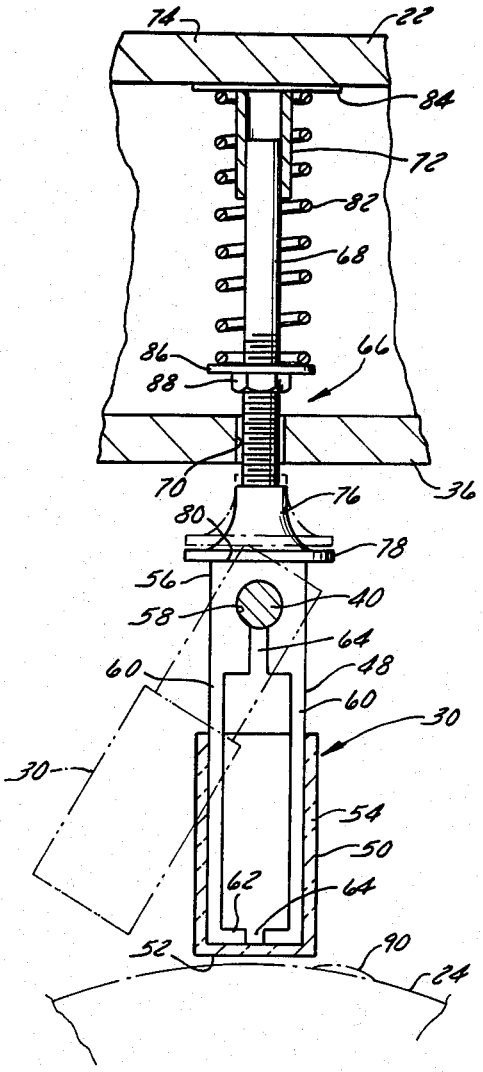
FIG. 4 is a fragmentary view partially in section, of a portion of one of the corona discharge electrodes illustrated in FIG. 1.
Figure 3:
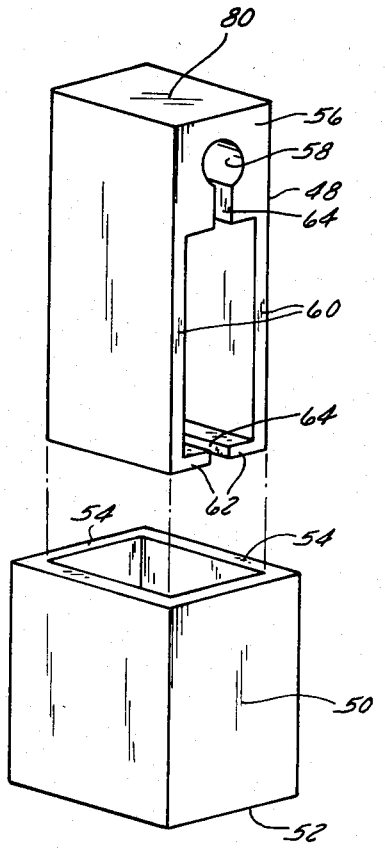
FIG. 3 is an exploded perspective view of one of the ceramic discharge electrodes.

The electrodes 30 are identical and accordingly only one will be described for the sake of brevity. In particular, each electrode 30 is shown in FIGS. 3 and 4 to include a conductive member 48 insulated at one end by means of a ceramic element 50. Each element 50 is cup shaped and generally includes a base 52 which is spaced a slight distance from and is oriented in a plane generally parallel to a plane tangent to the surface of roll 24. In addition, the element 50 also includes side walls 54 which extend normally upwardly from the base 52 to form a closed wall integral with the perimeter of the base 52. Although the element 50 is shown in the form of a rectangle or square, it should be understood that it can be formed in any other shape which conforms with the shape of the conductive member 48.

Preferably, the element 50 is formed of a ceramic material which is fabricated by high pressure and heat so as to minimize porosity. A high purity aluminum oxide has been found to be satisfactory, such as, for example one containing about 90% to about 99.5% aluminum oxide and preferably about 94–99.5% of this material. Other materials which may be employed are Mullite consisting of about 63.5% alumina and about 34.2% silica. Also ceramics containing about 47–76% alumina and about 24–53% silica may be employed.

The conductive member 48 is composed of a highly conductive material, such as aluminum or the like. The conductive member 48 includes a head portion 56 having a central opening 58 and a pair of legs 60 formed by a gap or space 64 which extends downwardly from the opening 58 in the head portion 56. Inwardly directed flanges or feet 62 may be provided at the end of each of the legs 60.

Means are provided for frictionally supporting the ceramic element 50 on the member 48. Such means is in the form of the space 64 provided between the legs 60 which tend to diverge slightly. Thus when the legs 60 are disposed between the side walls 54 of the element 50, the legs 60 will be compressed inwardly providing an inherent outward bias to the legs which frictionally hold the element 50 in position on the member 48. This also permits element 50 to be removed readily from the member 48 by merely sliding the element 50 off the ends of the legs 60. Additionally, when the legs 60 are brought together to receive the elements 50, the gap 64 will also be compressed whereby the opening 58 will resiliently grip the bars 38 and 40.

Means are provided in the frame 16 for holding the electrodes 30 in a fixed position but permitting the electrodes 30 to pivot about rods 38 and 40 in the event the electrodes 30 are engaged by the material being treated. Such means is in the form of a plunger assembly 66 disposed above each electrode 30. Each plunger assembly 66 includes a plunger rod 68 which extends upwardly through an opening 70 in the lower flange 34 of I-beam 20. The upper end of the rod 68 is telescooically received within a sleeve 72 which is fixed to the upper flange 74 of I-beam 20 and in coaxial alignment with the opening 70. At the lower end of rod 68 is a cap 76 having a flange 78 which engages the flat upper surface 80 of the head 56 of the electrode 48. A coil spring 82 surounds the rod 68 with the upper end of the spring 82 engaging the flange 84 of sleeve 72 and the lower end of the spring 82 engaging a washer 86 which bears against a suitable stop, such as nut 88, which is disposed on rod 68 above the opening 70.

The normal operating position of the electrodes 30 is shown by full lines in FIG. 4. However, should the electrodes 30 be engaged by a protrusion 90 in the material being treated, which may result, for example, when the material is spliced, the electrodes 30 will pivot outwardly to the broken line position shown in FIG. 4 to allow the protrusion 90 to pass. When the electrodes 30 pivot about the rod 38, one corner of the upper surface 80 of the head 56 will force the cap 76 and the plunger rod 68 upwardly to the broken line position thereby compressing the spring 82. This will exert spring pressure at the elevated corner of the head 56 thereby tending to pivot the electrode 30 back to its normal position after the protrusion 90 has passed. The plunger assembly 66 will thereby act to hold the electrodes 30 in their normal operating positions and to return the electrodes 30 to their normal positions should they be forced to pivot during operation. Because the element 50 and member 48 are held together by spring pressure rather than adhesive, the tendency to overheat is substantially minimized. Further, the ceramic elements 50 can readily be removed and replaced merely by sliding them from the legs 60 and inserting a new element. Further, if a web of narrower material is being treated, the unneeded electrodes 30 at the end of the roll can be rotated 90° out of position at which point they will be held by the plunger assembly 66.

While a single embodiment of the invention has been illustrated and described, it is not intended to be limited thereby but only by the appended claims.

The embodiments of the invention in which an exclusive property or privilege is claimed, are defined as follows:

1. A corona discharge device comprising a frame, a first elongate rod mounted on said frame, a first electrode assembly mounted on said frame, a second electrode assembly mounted on said rod in a fixed relation with respect to said first electrode assembly, said second electrode assembly having one or more electrodes each including an electrically conductive member having one end located in a spaced relation to said first electrode assembly and an aperture on the other end for mounting on said rod, a ceramic element enclosing said one end of said conductive member said conductive member including resilient means for frictionally retaining said ceramic element on the end of said member, plunger means mounted on said frame to resiliently engage each electrode and resiliently hold each electrode in an orientation generally radial relative to said rod, such that said electrodes may pivot on said rod if engaged by material passing around said first electrode assembly, and power source means operatively connected to said first electrode assembly and the said conductive member to produce a corona discharge in the space between said first electrode assembly and said ceramic element.

2. The device according to claim 1 wherein said ceramic element includes a base and a sidewall formed integrally around the perimeter of said base to define a hollow cavity.

3. The device according to claim 2 wherein said resilient means comprises a pair of legs on said conductive member spaced apart a distance greater than the distance between said sidewalls whereby said legs are compressed into said cavity.

4. The device according to claim 3 wherein said conductive member has a coefficient of expansion greater than said ceramic element and said space between said legs allows for thermal expansion inwardly within said sidewalls.

5. The device according to claim 1, wherein spacer means are provided on said frame includes an elongated rod, an aperture formed in each conductive member for being received on said rod, such that said electrodes can be mounted in side by side relation on said rod.

6. The corona discharge device according to claim 1 wherein said first electrode assembly includes a conductive roll, said frame includes a second elongate rod disposed generally parallel to said first rod and to said roll, said electrodes being mounted on said rods in a generally radial relation to said roll.

7. The corona discharge device according to claim 6 wherein spacer means are provided on said rods such that the electrodes on each rod are staggered one to the other so that the electrodes on one rod will occupy the gap between the electrodes on the other rod.

8. A corona discharge device comprising a frame including an elongate conductive rod, a first electrode assembly mounted on said frame, a second electrode assembly mounted on said rod in a spaced relation to said first electrode assembly, said second electrode assembly including a plurality of electrodes mounted on said rod in a parallel relation to the first electrode assembly, each electrode including a ceramic element and a conductive member having one end enclosed by said ceramic element and an aperture in the other end for receiving said rod, said conductive member including means for resiliently engaging said ceramic element, and a plunger means mounted on said frame to resiliently engage each electrode and resiliently hold each electrode in an orientation generally radial relative to said rod, such that said electrodes may pivot on said rods if engaged by material passing around said first electrode assembly.

power means connected to said electrode assemblies to produce a corona discharge in the space between said electrodes and said first electrode assembly.

9. A corona discharge device according to claim 8 wherein said ceramic element includes a base and a sidewall formed integrally around the perimeter of said base to define a hollow cavity, one end of said conductive member being housed in said cavity.

10. The device according to claim 8 or 9 wherein said conductive member has a coefficient of expansion greater than said element and is configured to allow for expansion inwardly within said element.

* * * * *